United States Patent [19]

Hufford

[11] 4,082,925

[45] Apr. 4, 1978

[54] ROTARY SWITCH

[75] Inventor: James N. Hufford, Elkhart, Ind.

[73] Assignee: CTS Corporation, Elkhart, Ind.

[21] Appl. No.: 672,468

[22] Filed: Mar. 31, 1976

[51] Int. Cl.[2] ..... H01H 19/54; G05G 5/00

[52] U.S. Cl. ..... 200/11 G; 200/11 K; 200/291; 200/292; 74/527; 74/531

[58] Field of Search ..... 200/11 R, 11 G, 11 J, 200/11 K, 292, 293–307, 290, 291; 74/527, 531

[56] References Cited

U.S. PATENT DOCUMENTS

| | | | |
|---|---|---|---|
| 2,834,842 | 5/1958 | LeBeau | 74/527 UX |
| 3,196,237 | 7/1965 | Westgate | 200/303 X |
| 3,293,399 | 12/1966 | Heinrich | 200/292 X |
| 3,300,594 | 1/1967 | Paine et al. | 200/292 X |
| 3,550,157 | 12/1970 | Pfleger | 200/292 |
| 3,586,797 | 6/1971 | Gerhardt et al. | 200/292 X |
| 3,699,279 | 10/1972 | Lockard et al. | 200/292 X |
| 3,975,601 | 8/1976 | Whelan | 200/153 LB |
| 4,034,178 | 7/1977 | Koppenheffer et al. | 200/11 TW X |
| 4,038,508 | 7/1977 | Mapelsden | 74/531 X |

*Primary Examiner*—James R. Scott
*Attorney, Agent, or Firm*—John J. Gaydos

[57] ABSTRACT

A multiposition rotary switch including a detent mechanism wherein a cam on the rotor acting through an arm resiliently deforms a portion of a side of the housing. A contactor constrained to rotate with the rotor wipably engages a plurality of contacts carried on a base in seriatim, each contact being defined by a portion of a conductor. The contacts can be arranged on the base to provide a variety of switching functions. An insulating material is adherently deposited on a predetermined location of at least one of the conductors carried by the base to provide a coded output. An annular bearing having a relatively large bearing area rotatably supports the rotor.

16 Claims, 7 Drawing Figures

ROTARY SWITCH

BACKGROUND OF THE INVENTION

The present invention relates to rotary switches and, more particularly, to a rotary switch having a detent mechanism.

The trend toward smaller electronic components has created a need to achieve functional equivalents of larger components with fewer parts thereby facilitating ease of assembly and reducing size and cost. In a miniature switch, the detent mechanism typically requires a plurality of parts and occupies valuable space. The reduction in size of rotary switches and particularly the detent mechanism of the switch presents problems attendant with a scaling down of size.

As the size of a switch is arithmetically reduced, the structural strength of the components of the switch is exponentially reduced. The prior art, as exemplified by U.S. Pat. Nos. 3,300,594 and 3,699,279 describes difficulties associated with miniature switches.

The prior art, as exemplified by U.S. Pat. No. 3,196,237, also shows a switch having a detent member in a segment of a portion of the switch housing. In such devices, the cammed rotor, when engaging the detent member, imparts a torsional moment to the detent member thereby increasing the stresses within the material of the supporting arms. These generated torsional stresses require that the supporting arm be less resilient to withstand the torsional stresses and thereby necessitates a reduction of the desired resilient characteristic. It is, therefore, desirable to provide a detent for a miniature rotary switch having an intermediate member disposed between the cam and the resilient member partially to insulate the resilient member from generated torsional force and thereby reduce the stress within the resilient member. It is further desirable that the intermediate member be integrally formed from the housing and maintained in position without necessitating additional parts and cost thereof.

As the siize of a switch is reduced and the forces generated by the detent members are not decreased proportionately, increased material stresses are encountered. When a rotor exerts pressure on a detent cam, an opposing pressure is exerted by the cam against the shaft of the rotor and the rotor support bearing. A small diameter shaft rotating in an appropriate diameter bearing presents a small bearing surface for withstanding the detent pressure. The prior art switches, as disclosed in patent application Ser. No. 496,973, issuing as U.S. Pat. No. 3,968,338 on July 6, 1976 assigned to the same assignee as the present invention, overcome this problem for a single-pole doublethrow switch wherein an actuator having a cam directly actuating the movable contact of the switch is supported by a rim of the housing. Such construction of the detent cam directly actuating the movable contact of a single pole switch has limited application. It is, therefore, desirable to provide a miniature multiposition rotary switch wherein the detent forces applied to the rotor are applied over a large bearing area thereby substantially reducing the stress therein.

In certain applications, the output of a rotary switch is indicative of the angular position of the rotor. A rotary switch having a binary coded output is ideally suited for a logic function control in machine tools, test equipment or the like. The prior art, as exemplified by U.S. Pat. No. 3,699,279 describes a switch having a coded output accomplished by a sheet of insulating material, such as mylar, provided with apertures therein at predetermined locations to permit selective electrical contact between the stator and the contactor upon rotation of the rotor. A coded output for a switch can also be achieved by arrangement of stator conductors to provide the coded output. Such stator conductors are produced either by an etching conductive material from a printed circuit insulator or the like, or by precise depositing of an intricate conductor upon a suitable stator material. It therefore would be desirable to provide rotary switches with a coded output that can be produced in a simple and facile manner.

Accordingly, it is an object of the present invention to provide a rotary switch with an improved detent. A further object of the present invention is to provide a miniature rotary switch wherein the stresses caused by the detent forces are minimized. Another object of the present invention is to provide a miniature switch wherein the periphery of the rotor is rotatably supported in a bearing. Yet another object of this invention is to provide a rotary switch wherein the detent utilizes a resilient portion of the housing. A further object of the present invention is to provide a rotary switch having a binary coded output.

Further objects and advantages of the present invention will become apparent as the following description proceeds, and the features of novelty characterizing the invention will be pointed out with particularity in the claims annexed to and forming a part of this specification.

Briefly, the present invention relates to a multiposition rotary switch having an improved detent mechanism and wherein a coded output is provided with a minimum of extra parts. The detent mechanism includes a cam integral with a rotor flange which in turn is rotatably supported by an annular bearing formed from the housing acts through a cam follower to deform resiliently a portion of a side of the housing. A contactor constrained to rotate with the rotor wipably engages a plurality of contacts carried on a base member. In an alternate embodiment, insulating means such as glass is deposited on portions of the arcuate conductors at predetermined locations thereof selectively to insulate electrically the contactor from the conductors thereby providing a coded output indicative of the angular position of the rotor.

BRIEF DESCRIPTION OF THE DRAWINGS

For a better understanding of the present invention, reference may be had to the accompanying drawings wherein the same reference numerals have been applied to like parts and wherein.

DETAILED DESCRIPTION OF PREFERRED EMBODIMENTS

Figure 1:
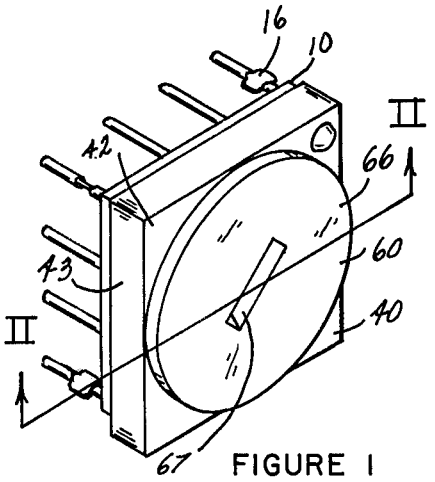
FIG. 1 is an isometric view of the switch of the present invention.

Referring now to FIGS. 1–4 of the drawings, the multiposition rotary switch of the present invention comprises a base 10, a plurality of spaced contacts 20 carried by the base 10, a contactor 30, a housing 40 and a rotor 60. The contactor 30 is secured to the rotor 60 and constrained to rotate therewith. The contactor 30 wipably engages and electrically connects a contact or collector 21 carried by the base 10 to the plurality of selectable contacts 20 in seriatim. The base 10 is secured to and closes one end of the housing 40. A detent is provided by a cam follower 41 formed from the housing 40, engaging in seriatim a plurality of indentations 61 peripherally spaced about a rotor flange 62.

More specifically, the base 10 comprises a generally square planar plate having a first side 11 and a second side 12. The base 10 may be composed of any material, such as a ceramic used in the present embodiment, having appropriate electrical insulation characteristics and that will adheringly accept a conductive material. A centrally disposed aperture 13 is provided in the base 10 and is adapted to accept a rotor shaft 63 therethrough. The contact or collector 21 is arcuate in shape and disposed on the first side 11 concentric with the aperture 13. The collector 21, the contacts 20, and a plurality of conductors 22 singly connected to each of the contacts 20 are each composed of an electrically conductive material as will be described hereinafter, adheringly deposited on the first side 11 by screening or a like manner old in the art. The contacts 20 are spaced at equidistant increments about an imaginary circle concentric with the aperture 13 at radial distance greater than the collector 21. A plurality of terminal apertures 14, one for the collector 21 and one for each of the contacts 20, are disposed peripherally in the base 10 in spaced relationship thereabout and extend from the first side 11 through to the second side 12. one end of one of a plurality of pins 15 is secured in an appropriate manner within each aperture 14. A tab 16 is provided on cornerwise disposed pins 15 to provide standoff support from a printed circuit board or the like. Each of the contacts 20 are connected to an aperture 14 by their respective conductor 22 and are electrically connected to the secured end of the respective pin 15 by solder or the like for electrical connection to an external circuit. The conductive material of the contacts 20, the collector 21, and the conductors 22 comprise conductive metallic particles of a palladium-silver alloy combined with a fritted glass particle filler and is fired after being deposited in a predetermined pattern by screening or like methods old in the art on the base 10. The glass can be most any suitable amorphous, inorganic, rigid solid fused from a melt compatible with the metallic particles including metal oxides in solution and vitreous or ceramic-like materials. The metallic particles can be of other appropriate metals such as the noble metals gold, platinum or any alloys thereof. The contactor engaging conductive members, i.e., the contacts 20 and the collector 21, contain a higher concentration of silver for improved abrasion resistance. The conductors 22 contain higher concentrations of palladium to improve solderability and facilitate connection to the pins 15. Both types of conductive material contain approximately 20 percent glass. When fired, the glass softens forming islands dispersed among the metallic particles and permeates the surface pores of the ceramic material of the base 10 firmly bonding and securing the conductive metallic particles to the substrate when cooled.

Figure 4:
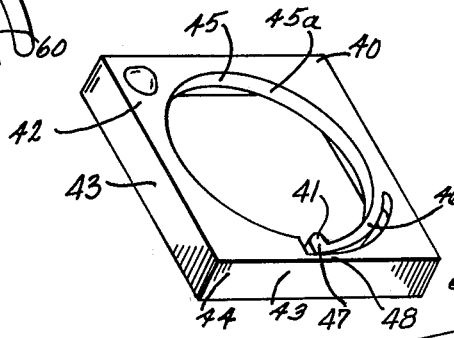
FIG. 4 is an exploded isometric view of the rotary switch of the present invention.
Figure 4:
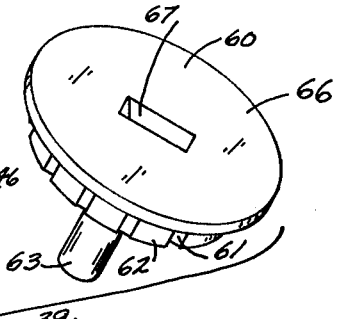
Figure 4:
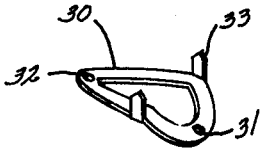
Figure 4:
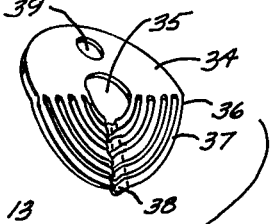

As best shown in FIG. 4 of the drawings, the contactor 30 is provided with an inner contacting protrusion 31 wipably engaging the collector 21. A contacting protrusion 32 is provided on the contactor 30 disposed diametrically opposite from the protrusion 31 for wipably engaging the contacts 20 in seriatim as the contactor 30 is rotated. The contactor 30 is made from a sheet of resilient metal such as spring brass and is formed to cause the protrusions 31 and 32 to abuttingly engage the contacts 20 and the surface 11 when the contactor 30 is compressed thereagainst. The contactor 30 is secured to the underside of the rotor flange 62 by a pair of oppositely disposed upwardly extending spaced ears 33 inserted into a pair of spaced complimentarily shaped bores 64 in the underside of the rotor flange 62. In an alternate embodiment, the contactor 30 can be configured for electrically connecting two or more of the contacts 20 to each other or to the collector.

In accord with the present invention, the rotor shaft 63 concentrically extends from the rotor flange 62 and passes through the contactor 30 and the aperture 13. The distal end of the shaft 63 is heat staked or rolled over to secure the rotor 60 to the base 10 at the second side 12 thereby providing a rotatable bearing within the aperture 13 and maintaining the contactor 30 under compression between the rotor flange 62 and the first side 11. As the rotor 60 is rotated by a rotational force applied to a rotor knob 66 formed from the flange 61 and is provided with a screwdriver slot 67. Upon applying a rotational force to the knob 66, the protrusion 31 wipingly engages the collector 21, and the protrusion 32 traverses the distances between the contacts 20 making electrical contact therewith in seriatim to the collector 21. The knob 66 rotatably constrains the rotor axially by bearing against a base wall of the housing.

An insulation means such as a film of glass 23 in adheringly deposited between the contacts 20 along the circular path traversed by the contacting protrusion 32 thereby forming a relatively smooth engagement surface for the protrusion 32. The ceramic material of the base 10 is abrasive and the abrasion of the protrusion 32 when traversing the distance between the contacts 20 will greatly reduce the contact life of the protrusion 32. Additionally, conductive metallic particles abraded from the protrusion 32 will smear between the contacts 20 eventually forming a conductive bridge therebetween. In the present embodiment, as the protrusion 32 traverses the distance between the contacts 20, the protrusion 32 rides on the smooth deposited film of glass 24 and is prevented from abradingly contacting the ceramic of the base 10 thereby extending the life of the protrusion 32.

Figure 5A:
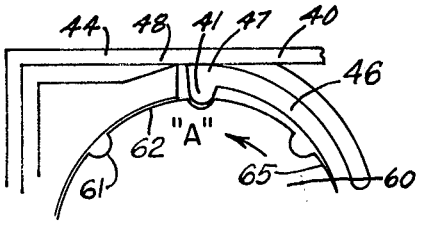
FIGS. 5A and 5B are fragmented plan views on an enlarged scale of the detent showing two functional positions.
Figure 2:
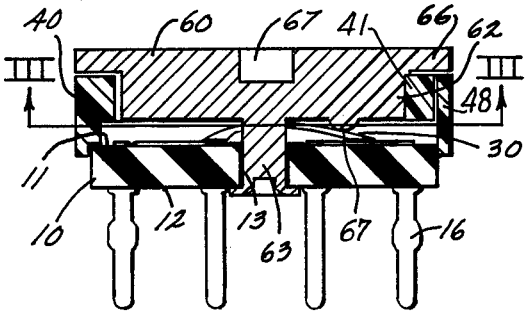
FIG. 2 is a sectional view taken generally along line II—II of FIG. 1.

According to the present invention, the housing 40 is generally boxlike in shape and is provided with a front wall 42 and four peripheral perpendicular side walls 43. One of the side walls 43 also serves as a detent wall 44. A bearing aperture 45, having a diameter substantially equal to the diameter of the flange 62, is disposed in the front wall 42 and is adapted to receive the rotor flange 62. Referring to FIGS. 3–5A and 5B, the cam follower 41 engages the indentation 61 of the rotor 62. The cam follower 41 is formed from the end of an arm 46 integrally formed from the front wall 42. The cam follower 41 is of a shape and size adapted to be at least partially received in the indentations 61 and is generally pointed in shape with the apex directed radially inwardly towards the rotor 60. The rear portion 47 of the cam follower 41 abuts against a portion 48 of the wall 44. FIG. 5A shows the relationship of the indentation 61 and the cam follower 41 when the cam follower 41 is at least partially received within an indentation 61. When the rotor 60 is rotated in the direction indicated by the arrow "A", the cam follower 41 rides up out from the indentation 61 on a cam 65 formed on the periphery of the flange 62 and is squeezed between the flange 62 and the side wall 44 with sufficient force to deform the portion 48 of the side wall 44 in the manner shown in FIG. 5B. The portion 48 of the side wall 44 is a relatively small portion of the side wall 44 and additionally is supported by the base wall 42. The portion 48 is tensioned outwardly and not strained to a degree to cause permanent deformation. In this transitional position, the contact protrusion 32 is position intermediate the contacts 20. As the rotor 60 is further rotated in the direction of the arrow "A", the contactor 32 will arrive at a contact 20 and at the same time the cam follower 41 will be forced into receiving relationship with a different positionally coincident indentation 61 (FIG. 5A) by the stored energy in the deformed portion 48 of the wall 44 thereby partially locking the rotor in place in a detent position and permitting the wall 44 to be resiliently restored.

Figure 5B:
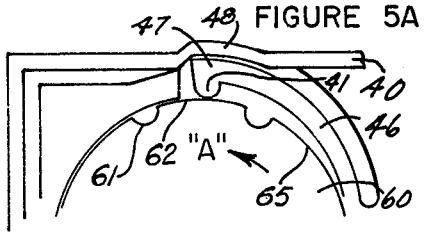

The housing 40 is made of a resiliently deformable material such as nylon and the portion 48 is thin enough to permit the amount of deformation necessary for the proper functioning of the detent. The arm 46, being integral with the housing 40, is also composed of the same deformable material. The cam follower 41 can be configured not to bottom out against or even partially distort the wall 44 in the detent position. In such embodiment, the deformation of the arm 46 in the translational position of FIG. 5B provides sufficient stored energy to seat the cam follower 41 in the indentation 61 after a rear portion 47 of the cam follower 41 has disengaged from the wall 44. The rotor can rotate in either direction.

The contacts shown in FIG. 4 are for a single pole 11 position rotary switch. The number of positions can be increased or decreased by changing the incremental spacing between the contacts and changing the incremental spacing between the indentations 61 and the terminal pins 15.

Figure 3:
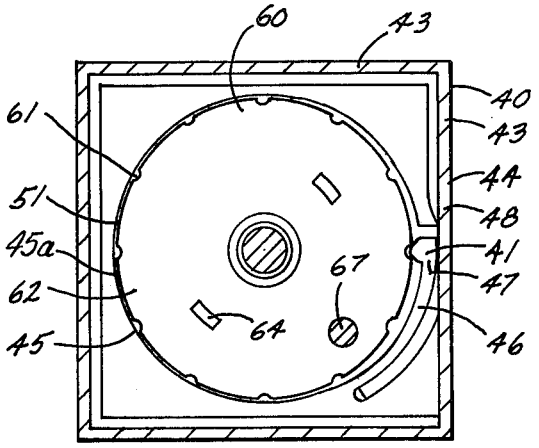
FIG. 3 is a sectional view taken approximately along line III—III of FIG. 2.

Referring to FIG. 3, the cam follower 41 either by itself or in conjunction with the side wall 44 provides a lateral force against the flange 62. This lateral force, being unidirectional, acts to bias the flange 62 away from the side wall 44. Since the diameters of the flange 62 and the aperture 45 are substantially the same, this lateral force causes the flange 62 to bear against an annular rim 45a of the aperture 45 and form a bearing area of contact 51 therebetween rather than a tangential point contact if the diameters of the flange 62 and the aperture 45 were substantially different. The area of contact 51 is disposed on the flange 62 diametrically opposite from the indentation engaged by the cam follower 41. As the rotor 60 rotates into the transitional position of FIG. 5B, the side wall 44 acting through the cam follower 41 further biases the flange 62 against the bearing rim 45a at the area of contact 51. The bearing area of contact 51 provides substantially greater bearing area than the bearing area between the substantially smaller diameter shaft 63 against the base 10 at the aperture 13 thereby reducing the internal stresses in the rotor 60, the housing 40, and the base 10.

Figure 6:
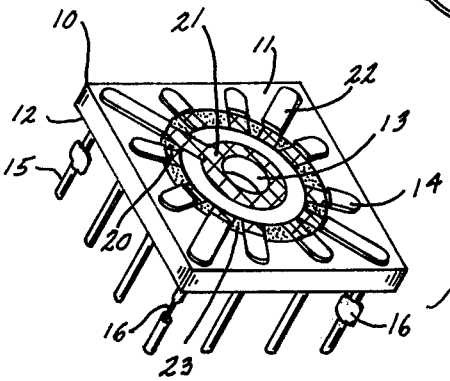
FIG. 6 is an exploded isometric view of an alternate embodiment of the contactor and the conductive paths.
Figure 6:
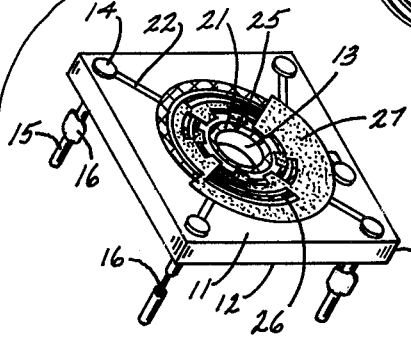

The pattern of the conductors 22 can be modified to provide a binary output indicative of the angular position of the rotor 60. Such an alternate embodiment shown in FIG. 6 employs a contactor 34 of resilient spring material. An aperture 35 concentrically disposed in the contactor 34 receives the rotor shaft 63. A contacting portion 36 of the contactor 34 is formed towards the base 10 and is provided with a plurality of concentric semicircular contacting arms 37 integral with the contactor 34. The contacting arms 37 are each provided with a contacting protrusion 38 extending toward the base 10. A plurality of contacts or conductors 25 and 26 are disposed on the first side 11 of the base 10 concentric with an aperture 35. In the exemplary embodiment, there are five contacting arms, an inner arm to contact the arcuate collector or conductor 25 and the other arms to each contact one of the plurality of the arcuate conductors 26. The contactor 34 is secured to and constrained to rotate with the rotor 60 by a rotor boss 67 extending through an acentric contactor aperture 39 and the contacting protrusions 38 wipably engage their respective arcuate conductors 25 and 26 when the rotor 60 is rotated.

An insulator such as a film of glass 27 is adheringly deposited in a predetermined pattern on the conductors 25 and 26. The glass can be any electrically insulating, amorphous, inorganic, rigid solid fused from a melt including vitreous and ceramic-like materials having the desired chemical and physical characteristics which can be fritted and formulated into a paste capable of being deposited on a substrate in a predetermined pattern by screening or like methods old in the art. The insulator of the exemplary embodiment is an aluminum borosilicate glass. The glass containing paste and the substrate, having the prior fired conductive pattern forming the conductors thereupon, are then fired at a suitable temperature to drive off the solvents in the paste and soften the glass particles to form the film of glass 27. During the firing of the base, the glass deposited thereon flows of bleeds slightly outwardly upon the side 11 based on the surface tension between the glass and the base material and permeates the surface pores of the ceramic material of the base 10. When cooled, the insulated glass solidifies forming a film of glass having a domed surface with a gradually thinning peripheral area and is bonded to the surface of the base 10 and the glass islands dispersed among the metallic particles of the contacts or conductors 25 and 26 forming a coating therefor.

The glass 27 being an insulator, determines whether a particular protrusion 38 will make contact with its respective path 26 at a given angular position of the rotor 60. As the contactor 34 is rotated, each of the conductors 26 is selectively connected to the collector 25 depending on whether the glass 27 is deposited on that portion of path 26. One of the values 1, 2, 4 and 8 is assigned to one of the conductors 26 and the combination of which conductors 26 are connected to the collector 25 at a given shaft position provides a binary indication of shaft position at the respective terminals 15. Additionally, the glass 27 is deposited on portions of the first side 11 between conductors 25 and 26, to prevent abrasion, at the same that the glass is deposited on the conductors 25 and 26, thereby achieving a coded output with no additional parts or production steps.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. A rotary switch comprising a housing defining a cavity, the housing comprising a resilient side wall, an electrically nonconducting base having a first surface and a second surface and secured to the housing, a plurality of spaced contacts disposed on the first surface at predetermined angular positions, the base being provided with a plurality of terminal apertures communicating from the first surface to the second surface, a plurality of pins secured in the apertures, a plurality of conductors disposed on the first surface and electrically connecting the contacts to the pins for connection to an external circuit, a nonconducting glass film adheringly disposed on the first surface and interposed between the spaced contacts, the base provided with a centrally disposed aperture, a rotor provided with a shaft, the shaft being received in the centrally disposed aperture and rotatably secured to the base, a contactor constrained to rotate with the rotor and wipably engaging the contacts, a cam disposed on the rotor, the cam being provided with a plurality of spaced indentations about the periphery of the rotor, and an arm integral with the housing, one end of the arm being secured to the housing and the other end of the arm engageable with the rotor and receivable in the indentations, the other end of the arm being disposed between the cam and the resilient wall and movable between the rotor and the resilient side wall whereby upon rotation of the rotor the other end of the arm engaged by the cam tensilely strains the resilient portion of the side wall of the housing.

2. The switch of claim 1, wherein the contacts are arcuate and concentrically disposed about the centrally disposed aperture in radial spaced relationship, one of the contacts being provided with a predetermined portion, a glass film adheringly coated on the predetermined portion, and as the contactor wipably engages the contacts and the glass, a coded output is obtained from the pins.

3. A rotary switch comprising an electrically nonconductive base, a plurality of spaced contacts carried by the base and disposed at predetermined angular positions on the base, terminal means for connecting the contacts to an external circuit, a contactor wipably engaging the contacts, a rotor constrained to rotate with the contactor, and positioning means for locating the contactor in any one of the predetermined angular positions, the positioning means comprising a cam extending from the rotor, a resilient member connected to the base and supported at oppositely disposed ends, and a cam follower connected to the base and operably cooperating with the cam, the resilient member being disposed radially outwardly of the axis of rotation of the rotor, the cam follower being disposed intermediate the cam and the resilient member and being movable therebetween, the cam follower comprising a front portion and a rear portion, the front portion of the cam follower abuttable with the cam, the rear portion of the cam follower abuttable with the resilient member, the resilient member being in operative cooperation with the cam follower whereby upon rotation of the rotor, the cam operating through the cam follower tensilely stresses the resilient member and compresses the cam follower.

4. The switch of claim 3, wherein a housing is secured to the base, and the resilient member and the cam follower are secured to the housing.

5. The switch of claim 4, wherein the resilient member is integral with the housing.

6. The switch of claim 5, wherein the base is integral with the housing.

7. A rotary switch comprising a housing, the housing being provided with a resilient portion, an electrically nonconductive base secured to the housing, a plurality of spaced contacts carried by the base and disposed at predetermined angular positions on the base, terminal means for connecting the contacts to an external circuit, a contactor wipably engaging the contacts, a rotor constrained to rotate with the contactor, and positioning means for locating the contactor in any one of the predetermined angular positions, the positioning means comprising a cam disposed on the rotor, and a cam follower integral with the housing and disposed intermediate the cam and the resilient member and being movable therebetween, the cam follower comprising a front portion and a rear portion, the front portion of the cam follower abuttable with the cam, the rear portion of the cam follower abuttable with the resilient member, the cam follower abuttingly engaging the cam whereby upon rotation of the rotor, the cam operating through the cam follower tensilely strains the resilient portion of the housing.

8. The switch of claim 7, wherein the rotor is provided with a plurality of indentations, and the cam follower is receivable in the indentations.

9. In a rotary switch, the combination comprising an electrically nonconductive base, a plurality of spaced arcuate contacts carried by the base, the contacts comprising conductive material deposited and fired onto the base, terminal means for connecting the contacts to an external circuit, one of the contacts being provided with a predetermined portion, an insulating material adheringly coating the predetermined portion, the insulating material comprising a fired glass film having smooth surface, a rotor rotatably supported in spaced relationship with the base, and a contactor constrained to rotate with the rotor and wipably engaging the contacts and the smooth surface of the glass film thereby providing a coded output.

10. The switch of claim 9, wherein the contacts are concentrically disposed and the insulating material adheringly coats a portion of the base.

11. A rotary switch comprising an electrically nonconductive base, a plurality of spaced contacts carried by the base and disposed at predetermined angular positions on the base, terminal means for connecting the contacts to an external circuit, a contactor wipably engaging the contacts, a rotor constrained to rotate with the contactor, and position means adapted to position the contactor in any one of the predetermined angular positions, the positioning means comprising a cam disposed on the periphery of the rotor and a resilient member connected to the base and supported at oppositely disposed ends and at an end therebetween, the resilient member being in operative cooperation with the cam whereby upon rotation of the rotor the cam causes the resilient member to be tensilely strained.

12. The rotary switch of claim 11, wherein the resilient member is an integral portion of a housing.

13. The rotary switch of claim 12, wherein the base is integral with the housing.

14. A rotary switch comprising a housing having a front wall and an annular rim, the annular rim having an arcuate bearing segment, a rotor having an annular flange rotatably supported at an area of contact disposed on the flange by the arcuate bearing segment, the flange having a diameter substantially the same as the diameter of the rim, a cam disposed on the flange of the rotor, a cam follower carried by the housing and operably cooperating with the cam, the housing being provided with a resilient portion supported at opposite ends, the cam follower being engageable with the resilient portion, an electrically nonconductive base secured to the housing, a plurality of spaced contacts carried by the base, terminal means for connecting the contacts to an external circuit, and a contactor constrained to rotate with the rotor and wipably engaging the contacts.

15. The switch of claim 14, wherein the cam is disposed diametrically opposite from the area of contact.

16. The switch of claim 15, wherein the resilient portion is integral with the housing.

* * * * *